US005893472A

United States Patent [19]

Forrer

[11] Patent Number: 5,893,472

[45] Date of Patent: Apr. 13, 1999

[54] SPOUT FOR VALVE ASSEMBLY

[76] Inventor: Scott M. Forrer, 1238 Lizbeth La., Cedarburg, Wis. 53012

[21] Appl. No.: 09/007,286

[22] Filed: Jan. 14, 1998

[51] Int. Cl.[6] ..... A61J 9/00

[52] U.S. Cl. ..... 215/11.4; 220/714; 220/717

[58] Field of Search ..... 215/11.4, 11.5; 220/714, 717

[56] References Cited

U.S. PATENT DOCUMENTS

| | | | |
|---|---|---|---|
| 2,623,524 | 12/1952 | Clemens | 215/11.4 |
| 2,803,251 | 8/1957 | White | 215/11.4 |
| 2,876,772 | 3/1959 | Witz | 215/11.4 |
| 2,979,078 | 4/1961 | Witz | 215/11.4 X |
| 4,135,513 | 1/1979 | Arisland | 215/11.4 X |
| 4,946,062 | 8/1990 | Coy | 220/714 |
| 5,072,842 | 12/1991 | White | 215/11.4 |
| 5,079,013 | 1/1992 | Belanger | 215/11.4 X |
| 5,101,991 | 4/1992 | Morifuji et al. | 215/11.1 |
| 5,607,073 | 3/1997 | Forrer | 215/11.4 |

*Primary Examiner*—Stephen K. Cronin
*Attorney, Agent, or Firm*—Joseph S. Heino

[57] ABSTRACT

An improved valve assembly spout is provided which contains a single hole or port at its uppermost portion. The improved spout is further provided with an inwardly extending, cylindrical straw-like member. Spout cavities are situated to either side of the straw-like member which facilitates entrapment of residual liquid contained within the spout after closure of the valve bridge is effected.

6 Claims, 1 Drawing Sheet

FIG. 1
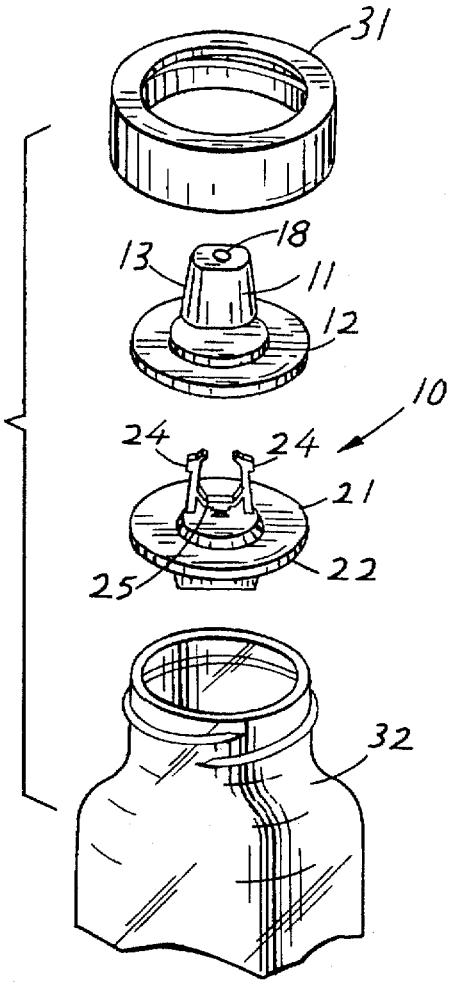
FIG. 2
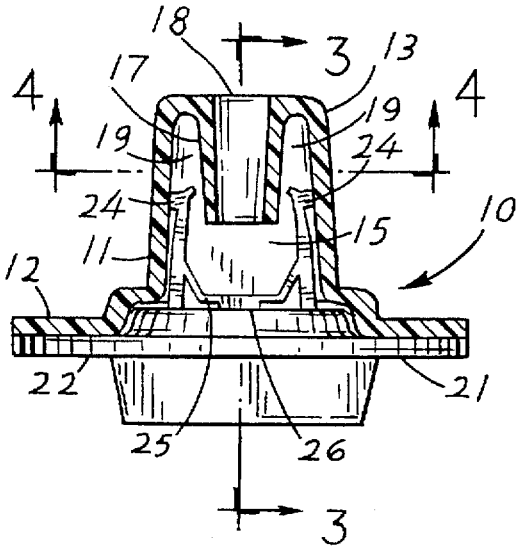
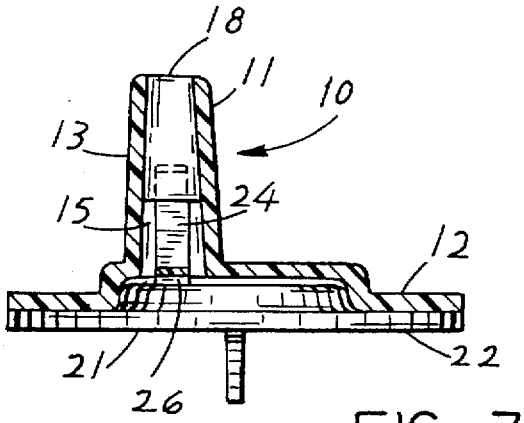
FIG. 3
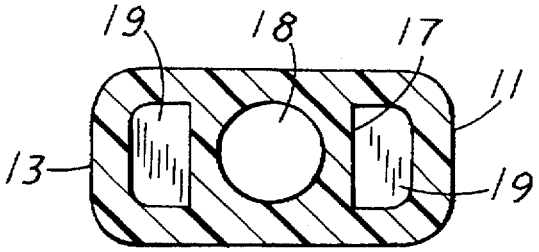
FIG. 4

SPOUT FOR VALVE ASSEMBLY

FIELD OF THE INVENTION

This invention relates generally to infant feeding and training containers, including toddler sipping cups and baby feeding bottles. More particularly, it relates to an improved spout for a valve assembly to be used with such feeding and training containers for controlling the flow of liquid from the container and, more importantly, for minimizing or eliminating drippage of liquid therefrom. This invention also specifically relates to an improvement of the inventor's valve assembly and mechanism as disclosed in U.S. Pat. No. 5,607,073.

BACKGROUND OF THE INVENTION

It has long been recognized by this inventor that babies and toddlers require some sort of controlled drinking mechanism when they start the self-feeding process. And this requirement continues for some time thereafter. Such devices have included and ranged from the most elemental type of baby bottle nipple to relatively complex spring-loaded valve mechanisms. In the construction of the inventor's valve assembly and mechanism for actuating and controlling liquid flow from a baby bottle or from a toddler's drinking cup, a spout and a spout insert are included. The spout includes a flanged spout member and a spout cavity through which liquid can flow. The spout overlays and sealingly engages a second flange which is configured as part of the spout insert. The spout insert also includes a pair of upwardly extending posts which project up and into the cavity of the spout. Extending between the posts is a valve bridge. This valve bridge overlays a hole defined in the spout insert through which liquid can flow when a suction force is applied to the spout. The posts and the bridge are constructed of resilient material, unlike the spout which is made of a generally rigid material and is not collapsible by a user's mouth. When no suction force is applied to the spout, the bridge effectively closes the hole.

In practice, the inventor has been apprised of a disadvantage in his system. And that disadvantage is that closure of the resilient valve bridge tends to trap a certain amount of liquid within the spout cavity. This trapped liquid has a tendency to drip from the spout of an inverted baby bottle or drinking cup even when no suction force is applied to the spout.

SUMMARY OF THE INVENTION

It is, therefore, a principal object of this invention to provide an improved valve assembly which minimizes or prevents altogether the leakage of liquid which may, from time to time, be trapped within the spout cavity. It is another object of this invention to provide such an improvement without requiring the fabrication of any additional members and by modifying existing members. It is yet another object of this invention to provide such an improvement by configuring a member which is interchangeable with existing assemblies. It is still another object of this invention to provide an improved assembly which is uncomplicated in design, easily usable and readily cleanable by a user or consumer thereof.

The improvement of the present invention has obtained these objects. It provides for an improved valve assembly spout which contains a single hole or port at its uppermost portion. The improved spout is further provided with an inwardly extending, cylindrical straw-like member. Spout cavities are situated to either side of the straw-like member which facilitates entrapment of residual liquid contained within the spout after closure of the valve bridge is effected. While disclosed by this inventor in a particular embodiment and used with toddler sipping cups and baby feeding bottles, it should be understood that the improvement of the present invention could be incorporated within other similar objects or devices used for the same purpose. The foregoing and other features of the improvement of the present invention will be further apparent from the description which follows.

BRIEF DESCRIPTION OF THE DRAWINGS

FIG. 1 is an exploded front perspective view of the valve assembly including the improved spout of the present invention as it is used with a conventional baby bottle.

FIG. 2 is an enlarged cross-sectional and front elevational view of the valve assembly and improved spout shown in FIG. 1.

FIG. 3 is another enlarged cross-sectional view of the valve assembly and improved spout shown in FIG. 2 but taken along line 3—3.

FIG. 4 is a further enlarged top perspective view of a portion of the improved spout shown in FIG. 2 but taken along line 4—4.

DETAILED DESCRIPTION

Referring now to the drawings in detail, FIG. 1 shows a valve assembly, generally identified 10, constructed in accordance with the improvement of the present invention. In the preferred embodiment, the valve assembly 10 includes a spout 11 and a spout insert 21. In the preferred embodiment, the valve assembly 10 is shown interposed between a baby bottle 32 which is filled with a consumable liquid and a bottle twist cap 31. While disclosed in this embodiment, the valve assembly 10 could be interposed between like members in similar devices used for the same purpose.

The spout 11 is so constructed and configured that it overlays the spout insert 21 of the valve assembly 10. The spout 11 includes a flanged portion 12 and an upwardly extending spout portion 13. Internal to the spout portion 13 is a spout cavity 15. The spout insert 21 includes a flanged portion 22 and a pair of upwardly extending posts 24 between which extends a valve bridge 25. The spout insert 21 is made of a somewhat resilient material and is quite unlike the spout member 11 which is made of a generally rigid material and is not collapsible by a user's mouth. The valve bridge 25 of the spout insert 21 overlays a hole 26. See FIG. 2. The resiliency of the upwardly extending posts 24 is such that, when the spout 11 is inserted over and onto the spout insert 21, the upwardly extending posts 24 are flexed toward each other and the valve bridge 25 is urged down onto and over the hole 26. This effectively closes the hole 26 thereby precluding the passage of liquid from the bottle 32 to the cavity 15 of the spout 11.

In the improved valve assembly 10, additional reservoirs within the spout 11 are provided. As shown in FIG. 4, the spout 11 and the upwardly extending spout portion 13 include a spout opening 18. The wall of the upwardly extending spout portion 13 is integrally formed with the walls of an inwardly extending cylindrical member 17 through which the opening 18 of the spout 11 extends. This effectively creates additional cavities or reservoirs 19 which are located to either side of the cylindrical member 17 of the spout 11, the significance of which will become more apparent further into this detailed description.

In application, the spout insert 21 is placed upon the opening of the bottle 32. The spout 11 is placed over the resilient and upwardly extending posts 24 of the spout insert 21. The spout 11 is then urged downwardly over the posts 24 until the bottom surface of the flanged portion 12 of the spout 11 becomes coplanar with the top surface of the flanged portion 22 of the spout insert 21. In this configuration, the upwardly extending posts 24 are urged toward each other and the valve bridge 25 effectively closes the hole 26 in the spout insert 21. The cylindrical spout member 17, which encircles the spout opening 18, extends below the uppermost portion of the spout insert posts 24. See FIG. 2. With the spout 11 and the spout insert 21 so located, the bottle twist cap 31 is twisted on to the neck of the bottle 32 and the valve assembly 10 is ready for use.

The bottle 32 is typically held in an inverted position to allow gravity to force the liquid contents of the bottle toward the top of the bottle. A suction force is then applied to the spout 11 which effectively creates a vacuum within the spout cavity 15 and allows the valve bridge 25 to be pulled away from the opening 26 of the spout insert 21. The liquid flowing from the bottle 32 and into the spout 11 then fills the spout cavity 15, and the additional cavities or reservoirs 19 located therein, and allows liquid to flow through the cylindrical spout member 17 and through the spout opening 18. When suction force is removed from the spout 11, the valve bridge 25 effectively closes the hole 26 and prevents passage of any additional liquid therethrough. At this point, a small amount of liquid is typically trapped within the spout cavity 15. In the experience of this inventor, that liquid will not be spilled through the spout opening 18 no matter how the spout is uprighted or inverted from this point forward due to its entrapment within the additional spout reservoirs 19.

From the foregoing detailed description of the illustrative embodiment of the invention set forth herein, it will be apparent that there has been provided an improved apparatus for actuating and controlling the liquid flow from a baby bottle and/or from a toddler's drinking cup.

The principles of this invention having been fully explained in connection with the foregoing, I hereby claim as my invention:

1. In a closure lid assembly for bottles or other containers which includes a first lid member, said first lid member having a flanged surface and a pair of flexible posts extending upwardly therefrom and a flexible bridge extending between said posts and over an orifice defined within said first lid member, and a second lid member, said second lid member being generally rigid and functionally adapted to overlay said first lid member and including a spout cavity into which the flexible posts of the first lid member extend, the improvement comprising an apertured member defined within the second lid member, said apertured member extending inwardly of the second lid member and into the spout cavity thereof.

2. The closure lid assembly of claim 1 wherein the improvement further comprises a plurality of reservoirs located within said spout cavity.

3. In a drinking nozzle apparatus for bottles or other similar containers which includes a base member, said base member comprising a generally planar disk having a pair of flexible posts extending upwardly from said disk, a cover member, said cover member being generally rigid and adapted to overlay said first lid member and having a spout cavity which is adapted to receive the posts of the base member there within, and a valve means defined between said base member and said cover member, said valve means including a flexible bridge extending between the base member posts for sealing an aperture defined within said base member and further including means for bringing said flexible bridge into sealingly engagement with said base member aperture when said posts are received within said cover member spout cavity and flexed toward each other, the improvement comprising an aperture defined within the cover member, said aperture being formed within a member which extends into the spout cavity of the cover member.

4. The drinking nozzle apparatus of claim 3 wherein the improvement further comprises a plurality of reservoirs located within said spout cavity.

5. In a valve assembly for bottles or other containers having a first valve member, said first valve member having a flanged surface and a pair of flexible posts extending upwardly therefrom and a flexible bridge extending between said posts, and a second valve member, said second valve member being generally rigid and further being functionally adapted to overlay said first valve member and including a spout cavity into which the posts of the first valve member extend, the improvement comprising an aperture defined within the second valve member, said aperture being formed within a member which extends into the spout cavity of the second valve member.

6. The valve assembly of claim 5 wherein the improvement further comprises a plurality of reservoirs located within said spout cavity.

* * * * *